United States Patent [19]

Betts

[11] 3,987,868

[45] Oct. 26, 1976

[54] SILENCING DEVICE FOR INTERNAL COMBUSTION ENGINES

[76] Inventor: William M. Betts, 400 SW. 12th Ave., Pompano Beach, Fla. 33061

[22] Filed: Feb. 22, 1974

[21] Appl. No.: 445,031

Related U.S. Application Data

[63] Continuation-in-part of Ser. No. 335,047, Feb. 23, 1971.

[52] U.S. Cl. ..... 181/57; 181/63

[51] Int. Cl.[2] ..... F01N 1/08

[58] Field of Search ..... 181/47, 49, 53, 54, 181/57, 59, 61, 63, 68, 72

[56] References Cited

UNITED STATES PATENTS

| | | | |
|---|---|---|---|
| 1,839,192 | 1/1932 | Baits | 181/49 |
| 2,122,086 | 6/1938 | Chase | 181/49 |
| 3,095,944 | 7/1963 | Buxton | 181/63 |
| 3,218,063 | 10/1940 | Munler | 181/57 |
| 3,220,506 | 11/1965 | Vernet | 181/63 |
| 3,473,323 | 10/1969 | Briggs et al. | 181/63 |
| 3,498,406 | 3/1970 | Heath | 181/63 |
| 3,589,469 | 6/1971 | Hasui | 181/59 |
| 3,670,845 | 6/1972 | Betts | 181/57 |

*Primary Examiner*—L. T. Hix
*Assistant Examiner*—Vit W. Miska
*Attorney, Agent, or Firm*—Neil F. Markva

[57] ABSTRACT

A silencing device or muffler for internal combustion engines comprises a hollow body including an outer shell having an inlet port and an outlet port. At least one apertured conical element or frusto-conical cup is arranged in the shell to form at least one inner expansion chamber therein. The conical element includes a completely solid wall structure that is impermeable to exhaust gas and has at least one opening along only the bottom portion thereof to cause all of the exhaust gases to move therethrough. A further feature includes a baffle plate disposed transversely of the interior of the shell and in operative relationship to the conical elements. The plate is shaped or apertured to permit a flow of exhaust gas around or through it when the gas passes into the shell and through the opening in said conical element.

19 Claims, 17 Drawing Figures

SILENCING DEVICE FOR INTERNAL COMBUSTION ENGINES

STATUS OF THE APPLICATION

This is a continuation-in-part application of application Ser. No. 335,047 filed Feb. 23, 1971.

BACKGROUND OF THE INVENTION

The present invention relates to silencing devices or mufflers intended for use in connection with internal combustion engines. More particularly, the device is used with engines of the type employed in lawn mowers, edgers, snow mobiles and other types of small vehicles. When fabricated with high heat fiberglass, such a device may be adpated to marine engines as a "wet type" silencer.

Silencers or mufflers for internal combustion engines are well known. One form of such prior art silencing device is disclosed in U.S. Pat. No. 2,122,086 which discloses the use of two conical elements having a plurality of openings around the entire periphery thereof. The conical elements act as a sieve. When the larger ends of the cones are connected together, a baffle member is required to be located between them. When the smaller end of the cones are directed toward each other, a baffle structure is required in the center to cooperate with the openings that extend completely around the circumferential surface of each conical element. This particular prior art silencer acts upon the frequency of the sound. It has been discovered that such a sieve-like conical configuration does not effectuate the kind of silencing that is desirable with respect to such a device.

PURPOSE OF THE INVENTION

The primary object of this invention is to provide a silencing device composed of a relatively few parts and has a simple and sturdy construction.

A further object of this invention is to provide a silencing device having at least one conical element with a very specific type of apertured configuration which overcomes advantages associated with known prior art devices.

Another object of this invention is to provide a silencing device which will have a long service life under hard use and which will perform the desired muffling operation without causing any material loss of power by reason of back pressure.

SUMMARY OF THE INVENTION

These objects and other advantages will be attained through the use of the invention as described herein. The silencing device comprises a hollow body including an outer shell having an inlet port and an outlet port. At least one conical element is disposed within the hollow body to form at least one expansion chamber for exhaust gases passing through the shell.

The conical element includes a completely solid wall structure that is impermeable to exhaust gas and has at least one opening along only the bottom portion thereof to cause all of the exhaust gases to move therethrough. That is, this opening is located at a position below the center line of the conical element. The single gas exhaust area of a single opening or a plurality of openings located in the bottom portion of the conical element is from about 1 to 1⅓ times of the size of the inlet port of the silencing device.

Another feature of the invention is directed to the use of a small perforated pipe extending from the inlet opening into the interior of the hollow body. The perforated pipe includes openings having a total area that is substantially equal to the area of the opening in the conical element. In one specific embodiment, the conical element has a larger end open toward the inlet port and the perforated pipe extends completely into the area defined by the conical element. All of the openings formed in the perforated pipe in that embodiment are located within the confines of the area defined by the conical element.

Another feature of the invention is directed to the use of a pair of conical elements disposed within the hollow body in endwise relationship with respect to each other to form at least one expansion chamber for the exhaust gases passing through the shell. The conical elements may be substantially frusto-conical in shape and secured together with their small ends in contact. In another embodiment, the elements may have larger ends which are in abutment to form a single expansion chamber therebetween.

A further feature of the invention is directed to the use of a baffle plate secured to at least one of the conical elements when there are a pair of elements in an end-to-end relationship with respect to each other. The baffle plate is disposed around the periphery of the conical elements at connected ends thereof and has a structural configuration effective to allow the passage of the exhaust gases.

A still further feature of the invention is directed to the specific manner in which the shell includes two tubular body parts having interlocking flanges at one end to join them together thereby forming the hollow body. One of the body parts includes the inlet port and the other of the body parts includes the outlet port. A pair of cones is disposed in the hollow body and are placed together to form a single interrupted expansion chamber. The cones have their larger ends in contact with their lateral parts in the form of flanges which are fitted between the flanged ends of the body parts. The point of joining the two cones is at the substantial center of the hollow body formed in the silencing device. This feature not only incorporates the significant improvements associated with silencing functions but also the improvements associated with the structural integrity of the muffling unit.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
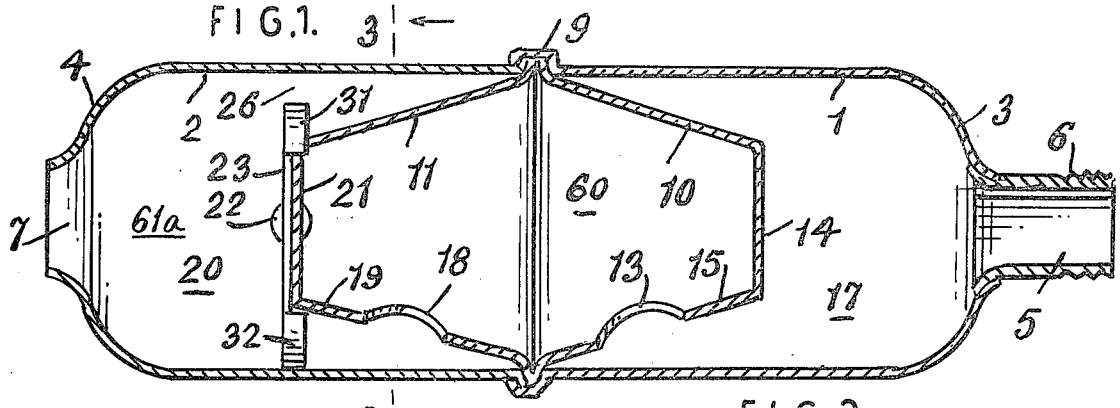
FIG. 1 is a longitudinal sectional view through a muffler made in accordance with the invention.

More specifically, referring to the drawings, the silencing device includes a hollow body having an outer shell consisting of two half sections 1 and 2. The half sections 1 and 2 are substantially tubular and similar in shape and have rounded ends 3 and 4, respectively. The rounded end 3 of the cylindrical body section 1 has a centrally positioned inlet port 5 including external screw thread 6. Thus, the inlet port 5 may be attached to the exhaust port of an engine.

The rounded end 4 of the cylindrical body section 2 has an outlet or exhaust port 7 for the silencing device. The inlet port 5 and the exhaust port 7 are disposed in substantially longitudinal alignment with respect to the hollow body formed by the cylindrical sections 1 and 2.

Figure 6:
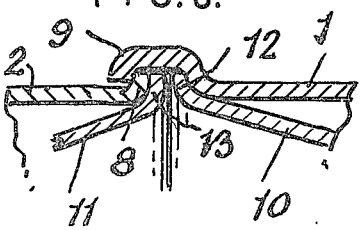
FIG. 6 is a fragmentary sectional view of a joint or connection between the shell or body sections.

The cylindrical body parts 1 and 2 include flanges 8 and 9, respectively, at their open ends. See the detail drawing of FIG. 6. Flange 9 extends over the upturned flange 8 thereby coupling the body sections 1 and 2 together to form the outer shell or hollow body. When the body sections 1 and 2 are composed of fiberglass, the joint between the flanges 8 and 9 is chemically welded so that the resultant assembly has a one-piece constructions.

Two conical elements 10 and 11 are fixedly mounted within the hollow body. The conical elements have a frustoconical shape and are referred to as "cones." In the specific embodiment of FIG. 1, cones 10 and 11 are disposed endwise with respect to each other within the shell to form at least one expansion chamber. Cones 10 and 11 have their larger ends in abutment with respect to each other to form a single expansion chamber 60 therebetween. Out-turned flanges 12 and 13 meet at the transverse center line of the hollow body and are confined between the flanges 8 and 9 to hold the cones 10 and 11 in position within the hollow body.

As is evident in the drawings and other disclosure herein, the conical elements have an open base and closed top. A single gas area is defined by at least one exhaust opening located along only the bottom portion of the conical elements.

The cones 10 and 11 have a completely solid wall structure that is impermeable to exhaust gas. The solid wall structure of cone 10 includes an imperforate wall 14 and has at least one large opening or port 13 which faces downwardly within the muffler body as shown in FIG. 1. It is important that the opening be formed only along the bottom portion of the conical elements 10 and 11. That is, the opening must be formed below the horizontal longitudinal plane. The openings 13 and 18 establish communication between the chamber 60 and the chamber 17 located in body section 1 and extending around the exterior of cone 10.

The area of the opening 13 is from about 1 to 1⅓ times the area of the inlet port 5. This relationship is important to insure a free flow of exhaust gases through the openings in the interior of the hollow body.

Cone 11 has at least one opening or port 18 in its completely solid wall structure 19. The size opening 18 is the same as that of opening 13 and establishes communication between chamber 60 and the chamber 20 located within body section 2 and extending around the outside of cone 11.

Figure 2:
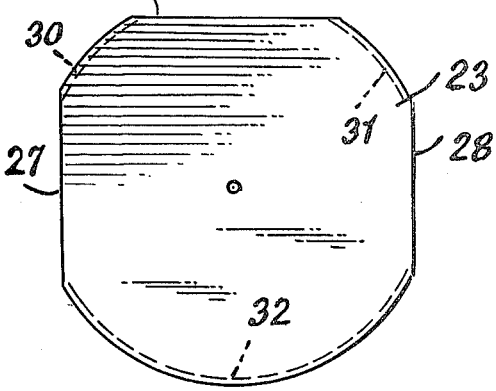
FIG. 2 is a plan view of the muffler baffle plate.
Figure 3:
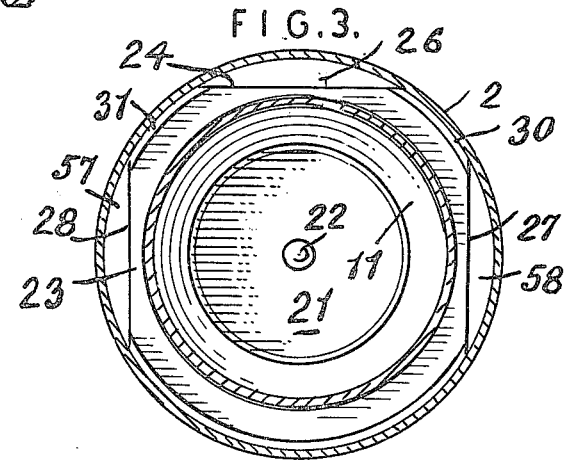
FIG. 3 is a sectional view taken along line 3—3 of FIG. 1, looking in the direction of the arrows.
Figure 4:
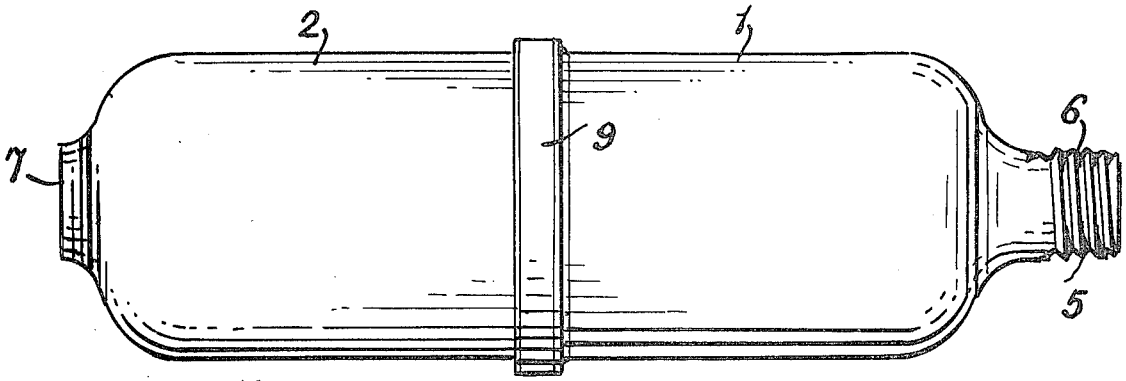
FIG. 4 is a side elevational view of the muffler.
Figure 5:
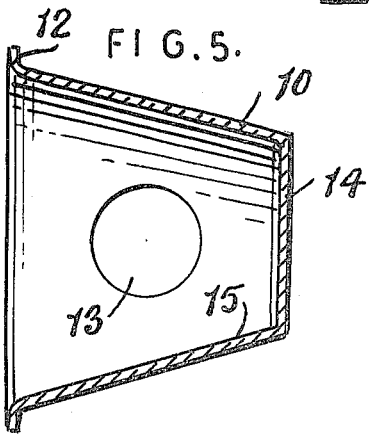
FIG. 5 is a sectional view downwardly through one of the frusto-conical elements.

A baffle plate 23 is attached to a central point of the end wall 21 of cone 11 by rivet 22. The shape of baffle plate 23 and the manner in which it fits within the hollow body section 2 is shown in FIGS. 2 and 3. A top portion is cut away from the baffle plate 23 to form the top edge 24. Thus, a spacing 26 is located between top edge 24 and the inside wall surface of body section 2. Side portions are removed from the baffle plate to form opposite side edges 27 and 28 which provide spacings 57 and 58, respectively, between the baffle plate 23 and the inside of the body section 2.

Flanges 30, 31, and 32 are formed along the edge of the baffle plate 24 to be in contact with the inside wall surface of body section 2 as shown in FIG. 3. Flanges 30, 31, and 32 are bent at substantially right angles to the plane of the baffle plate 23 and constitute deflectors for the exhaust gas within the hollow body.

In operation, exhaust gas enters expansion chamber 17 from the engine through inlet port 5. Gas then passes through the opening or port 13 into the inner expansion chamber 60 causing further expansion to take place. The exhaust gas then flows from chamber 60 through the opening 18 into the chamber 20 via the spaces 26, 57 and 58 disposed around baffle plate 23 and finally out the exhaust outlet 7. In other words, the exhaust gases are directed in one direction through the walls of the cone via each of the openings 13 and 18.

In theory, the silencing device as described herein traps the noise from the engine as a result of the configuration and construction of the conical elements 10 and 11. While not being limited to the theoretical explanation, it is believed that the noise is carried along by the flow of the exhaust gases. The flow of the warmer gases upwardly through the opening 13 of cone 10 causes the sound to bounce off the completely solid wall structures 15 and 19 within the expansion chamber 60. Therefore, it is necessary that the openings 13 and 18 be located in the bottom portion of the conical elements 10 and 11, respectively. Thus, the course followed by the gas flow as described hereinabove results in an effective reduction in noise without creating material back pressure.

In the embodiments shown in FIGS. 7 through 10, the conical elements 41 and 42 have a substantially frustoconical shape and are secured together with their small imperforate ends 43 and 44 secured together by a central rivet 45. The larger or open ends 46 face away from one another or in opposite directions with respect to each other. The open end of cone 41 cooperates with the body section 1*a* to form a relatively large expansion chamber 61 into which exhaust gas enters through inlet port 5. The larger end of cone 42 cooperates with body section 2*a* to form a relatively large expansion chamber 61a out of which the exhaust gas is expelled through outlet port 7. The edges of the cones 41 and 42 located at the outer ends 46 abut the circumferential ledges 40 formed in circumferential body sections 1a and 2a as shown.

Again, at least one opening 47 is formed in the bottom portion of cone 41 and at least one opening 48 is formed in the cone conical element 42. Any noise coming into the conical elements 41 and 42 bounces off the completely solid wall structure where it is substantially eliminated while the exhaust gases themselves are allowed to pass through the openings 47 and 48 for ultimate exhausting through outlet port 7. The size relationships of openings 47 and 48 with respect to the inlet port 5 and outlet port 7 is the same as that discussed hereinabove with respect to the openings 13 and 18 of FIG. 1.

As is evident in the drawings, the single gas area is located at a point laterally displaced with respect to the open bases 46. Each open base 46 is disposed between the exhaust openings 47 and 48 and one of the inlet and outlet ports 5 and 7, respectively. The exhaust openings 47 and 48 are each sufficient in size to cause all of the exhaust gases which pass through the silencing device to move through each open base 46 and the exhaust openings 47 and 48. The exhaust openings 47 and 48 are located in the cone-shaped bottom portion of the conical elements 41 and 42, respectively.

Figure 7:
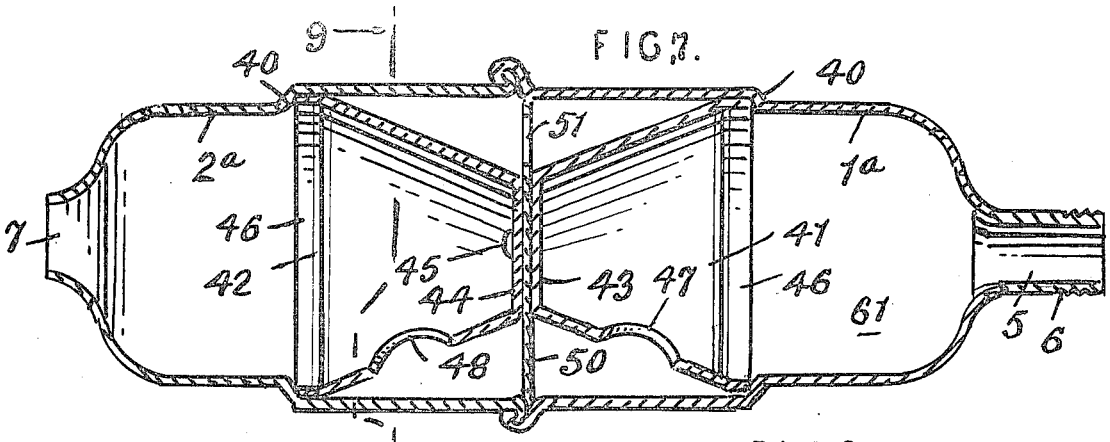
FIG. 7 is a longitudinal sectional view through another embodiment of the invention.
Figure 8:
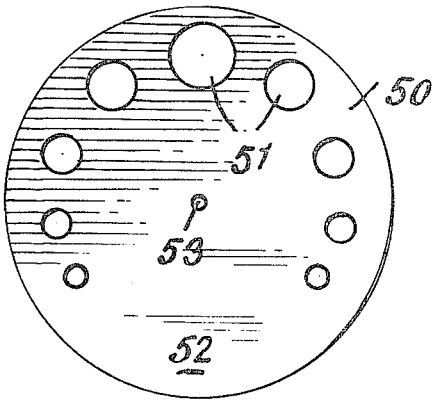
FIG. 8 is a plan view of the apertured baffle plate employed in the muffler shown in FIG. 7.
Figure 9:
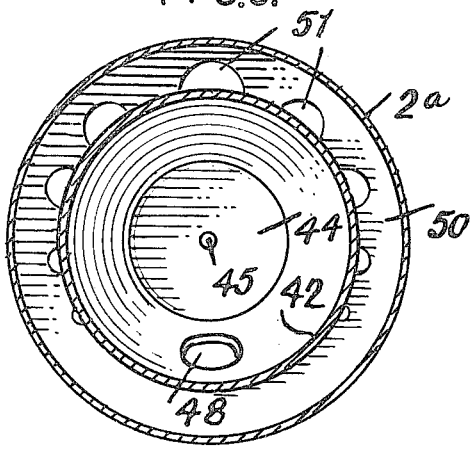
FIG. 9 is a sectional view taken along line 9—9 of FIG. 7, looking in the direction of the arrows.

A flat disk-shaped baffle plate 50 is fixedly disposed between the end walls 43 and 44 by rivet 45 extending through hole 53. If necessary, the edges of baffle plate 50 may be engaged by the flanges (not numbered) which unite the two half sections 1*a* and 2*a* of the hollow body as shown in Figure 7. The baffle plate 50 includes an arcuate row of holes 51 disposed adjacent to its peripheral edge. Holes 51 are graduated in size and extend for some distance around the baffle plate 50 near its outer edge. An imperforate portion 52 is located around the lower part of the baffle plate 50 when disposed within the hollow body.

When installed, the largest diameter hole 51 is located at the top of the muffler. The remaining holes 51 are located around the outside of the inclined wall surfaces of the cones 41 and 42. The diameter of the baffle plate 50 is greater than the diameter of the cone ends 43 and 44 so that the apertured area of baffle plate 50 projects laterally beyond cone ends 43 and 44.

Figure 10:
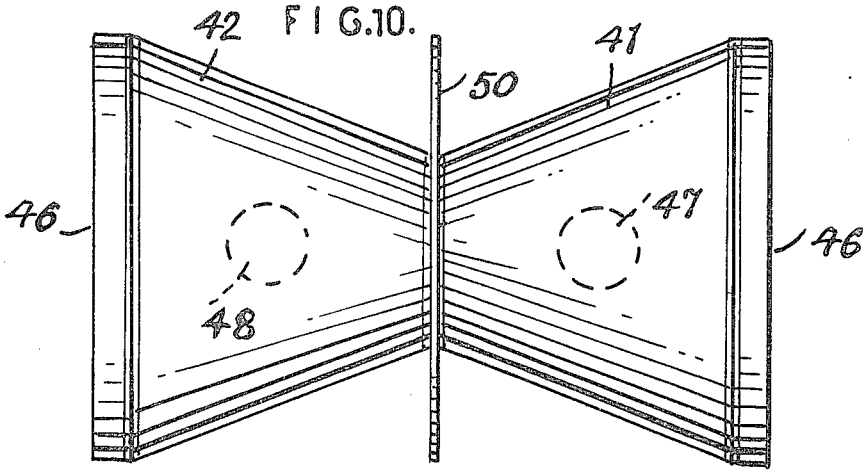
FIG. 10 is an elevational view of the cone assembly.

The imperforate portion 52 of the baffle plate 50 is located in the lower section of the muffler adjacent the openings 47 and 48. The cone assembly as shown in FIG. 10 consists of the two united cones 41 and 42 with the baffle plate 50 therebetween. The cone assembly is held from longitudinal shift within the body of shell by the abutment of the larger ends against the ledges 40.

In operation, exhaust gases flow into the expansion chamber 61 from the inlet port 5. The gas exhaust then passes through opening 47, flows around the inclined outer wall of cone 41 and passes through the holes 51 thus entering into the interior of cone 42 through the opening 48. The gas expands into the expansion chamber 61a defined by the interior of cone 42 and body section 2a. The sound carried by the exhaust gases bounce around within the completely solid wall structures of thecones 41 and 42 where it is substantially eliminated. This action on the part of the sound waves is possible only when the openings 47 and 48 are disposed only along the bottom portion of the cones 41 and 42, respectively, as shown.

Figure 11:
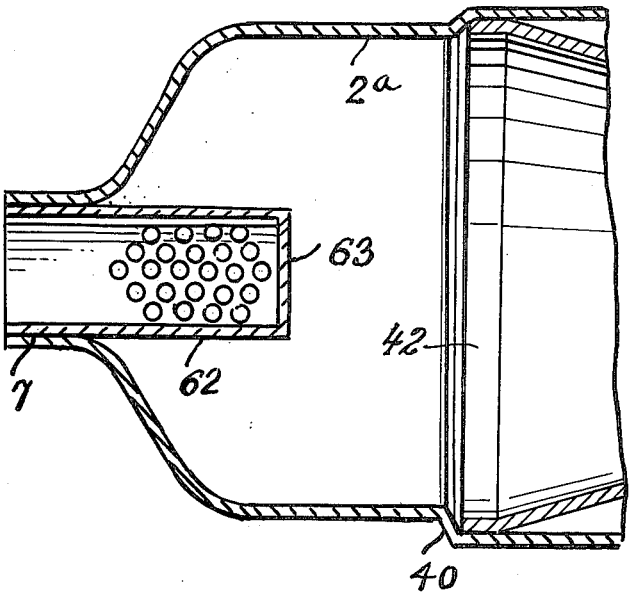
FIG. 11 is a fragmentary, longitudinal sectional view of a modified embodiment made in accordance with the invention.
Figure 12:
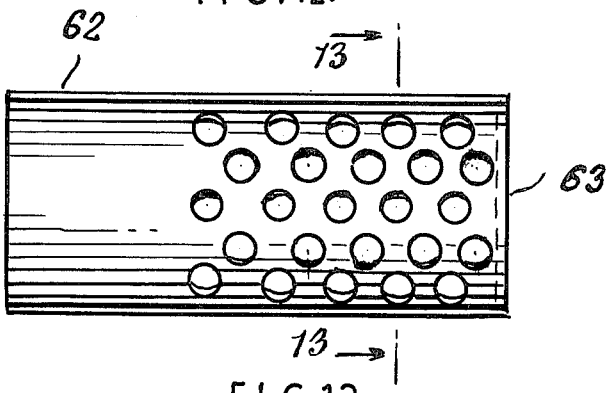
FIG. 12 is an elevational view of the perforated cup shown in FIG. 11.
Figure 13:
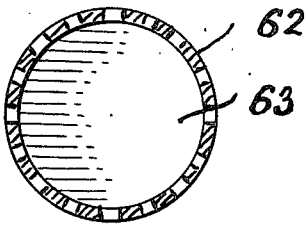
FIG. 13 is a sectional view taken along line 13—13 of FIG. 12.

A further feature of the invention is shown in FIG. 11. An apertured or foraminous cup 62 is disposed in the exhaust port 7. Cup 62 has a closed imperforate end 63 which faces toward the interior of the body or shell toward the large open end of cone 42. Cup 62 may be spot welded in place within the exhaust outlet 7 as shown. (The number of holes may be varied. The total area of the holes in cup 62 should be slightly greater than the area of the exhaust outlet 7.) The cone 42 as shown in FIG. 7 is also shown in FIG. 11.

Figure 14:
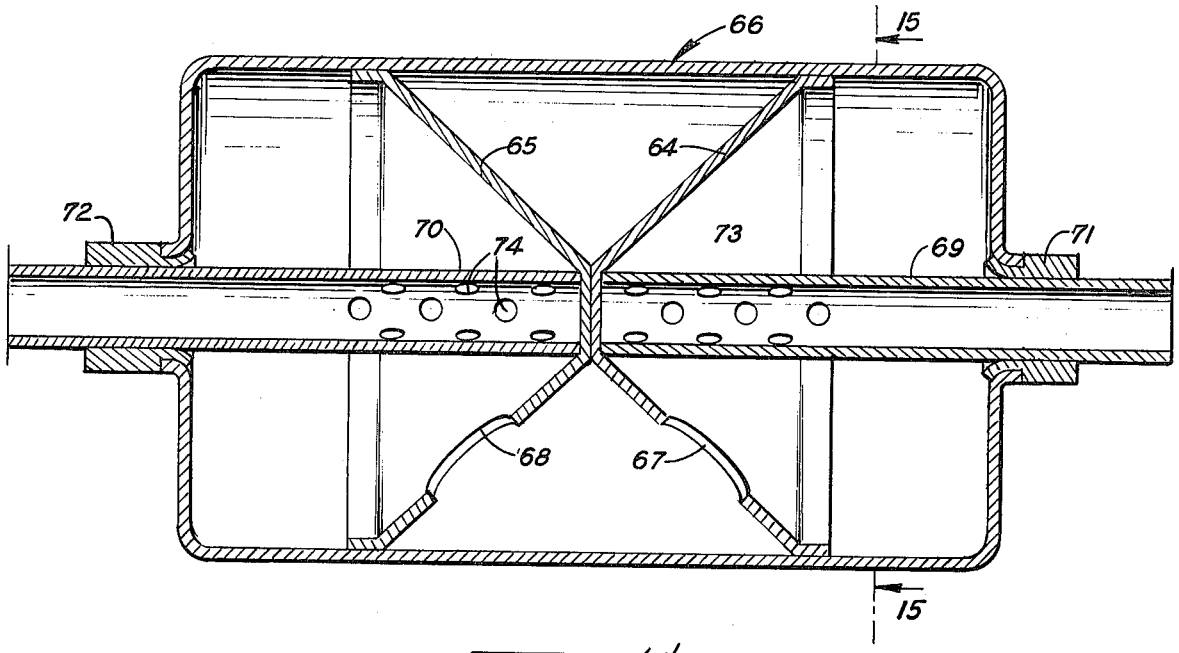
FIG. 14 is a longitudinal sectional view of a still further embodiment of a muffler made in accordance with this invention.
Figure 15:
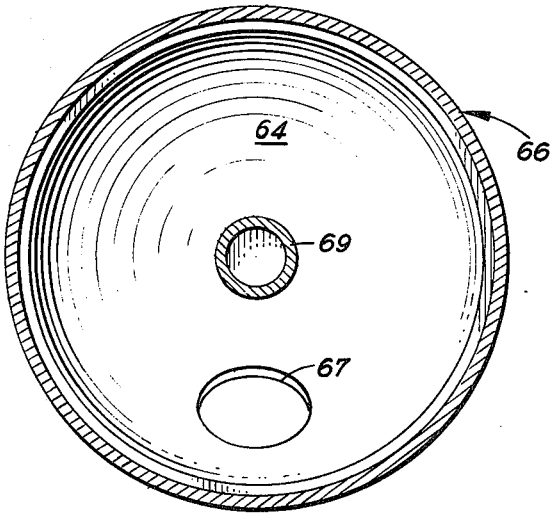
FIG. 15 is a sectional view taken along line 15—15 of FIG. 14.

Another embodiment of the silencing device made in accordance with this invention is shown in FIG. 14. Conical elements 64 and 65 have a substantially frusto-conical shape and are secured together with their small ends in contact. Conical elements 64 and 65 are secured in any desirable manner such as welding within the outer shell configuration generally designated 66. Shell 66 may be formed in any desired manner in accordance with the teaching of this application or in accordance with any prior art technology.

Cones 64 and 65 include a completely solid wall structure that is impermeable to exhaust gas. At least one opening 67 and 68 is located in each cone 64 and 65, respectively, along only the bottom portion thereof. A perforated tube 69 extends from the inlet port 71 to the bottom end of the cone element 64. Another perforated tube 71 extends from the outlet port 72 to the small end of the conical element 65. Structural rigidity is improved along with the muffling capacity of the device.

The tubes 69 and 70 include holes 73 and 74, respectively, that are located along the length thereof but are confined within the volume or area defined by the conical elements 64 and 65. The total area of the holes 73 and 74 are equal to the area of the openings 67 and 68, respectively. Further, each of the openings 67 and 68 has an area that is in the range of from 1 to 1⅓ times the area of the inlet and outlet ports 71 and 72. For example, where the inlet and outlet openings of the outlet port 71 and 72 have a diameter of three inches, the opening of each of the holes 67 and 68 must be between about 1 to 1⅓ times the area of the three inch port. A more limited range is from 1.1 to 1.2 times the port area and the best relationship is when the area of each of the holes 67 and 68 is 1.15 times the inlet port area.

Figure 16:
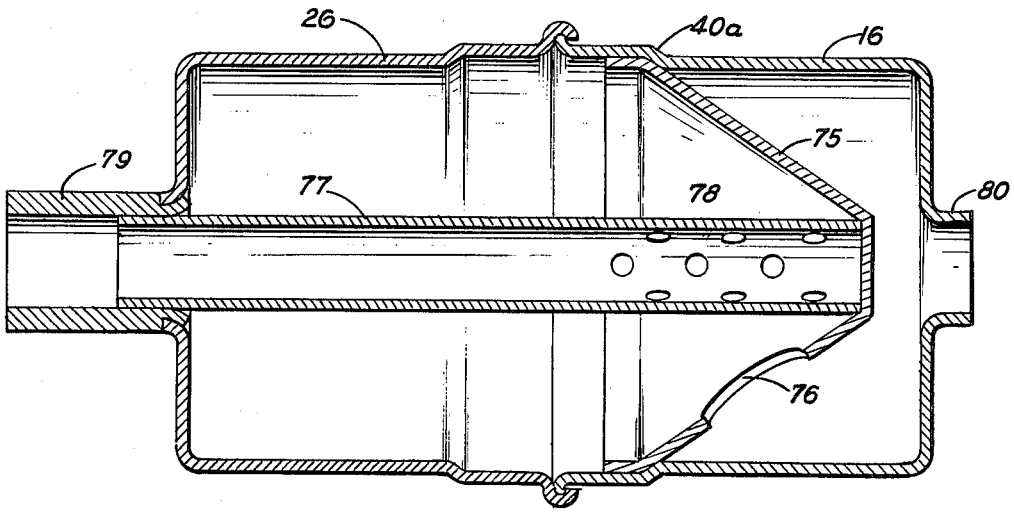
FIG. 16 is a longitudinal sectional view of a still further embodiment of a silencing device made in accordance with this invention.

The embodiment of the silencing device made in accordance with this invention and referred to as resonator is shown in FIG. 16. A single conical element is mounted against the abutment ledge 40*a* of shell cylindrical section 1*b*. The conical element 75 has a completely solid, exhaust gas impermeable wall structure with at least one opening 76 located along only the bottom portion thereof. A perforated tube 77 includes holes 78 and extends from the inlet opening 79 to the small end of the frusto-conical cone 75. The exhaust gas enters the inlet 79, goes through openings 78 and out the openings 76 and exhausts through the exhaust port 80. The resonator of FIG. 16 functions substantially in the same manner as the earlier embodiments described hereinabove.

Figure 17:
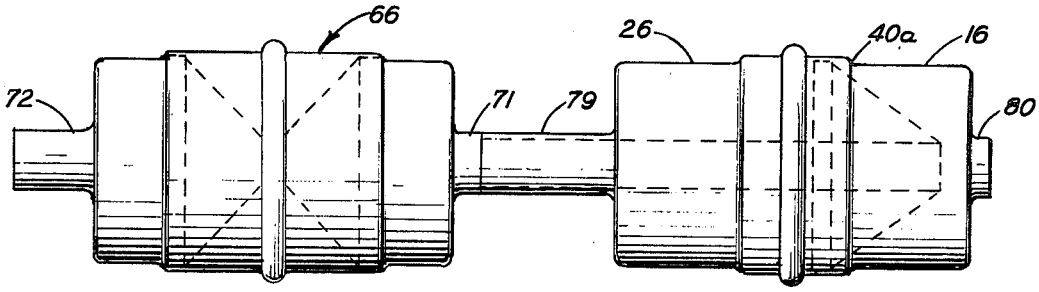
FIG. 17 is an elevational view showing a combination of the embodiments of FIGS. 14 and 16.

The combination as shown in FIG. 17 shows a muffler having two conical elements connected in series with a resonator having only one conical element. This arrangement enables a substantially complete elimination of all noise. The muffler acts to eliminate 75 to 85% of the noise and the resonator acts to eliminate the balance of the noise.

While the silencing device for internal combustion engines has been shown and described in detail, it is obvious that this invention is not to be considered as being limited to the exact form disclosed, and that changes in detail and construction may be made therein within the scope of the invention, without departing from the spirit thereof.

Having this set forth and disclosed the nature of this invention, what is claimed is:

1. A silencing device comprising:

a. an outer shell defining a hollow body and including an inlet port and an outlet port, b. at least one substantially conical element that has an open base, closed top, and is disposed within the hollow body to form at least one expansion chamber for exhaust gases passing through the shell, c. said conical element comprising a completely solid wall structure that is impermeable to exhaust gas and has a single, gas exhaust area for directing exhaust gases in one direction through the wall of the cone along only the cone-shaped, bottom portion thereof at a point laterally displaced with respect to said open base, d. said open base being disposed between said exhaust opening and one of said inlet and outlet ports, said gas exhaust area being at least as large as the area of said inlet port to cause all of the exhaust gases which pass through said silencing device to move through said open base and said exhaust opening.

2. A device as defined in claim 1 wherein the conical element has a larger end and a smaller end with the larger end being disposed closer to the input port than said smaller end, a perforated tube extends from the inlet port into the chamber formed by the conical element, said perforated tube includes perforations having a total amount of area substantially equal to the amount of area of said gas exhaust area in the bottom portion of the conical element.

3. A device as defined in claim 1 wherein there is a pair of said conical elements connected together in endwise relationship with respect to each other to form at least one expanision chamber for exhaust gases passing through the shell.

4. A device as defined in claim 1 wherein the shell includes two tubular body parts having interlocking flanges at one end to join them together thereby forming said hollow body, one of said parts includes the inlet port and the other of said parts includes the outlet port.

5. A device in claim 2 wherein p1 the area of the said gas exhaust area in the conical element si in the range of from about 1 to 1 ⅓ times the area of the inlet port.

6. A device as defined in claim 2 wherein the conical elements have larger ends which are in abutment to form a single expansion chamber therebetween.

7. A device as defined in claim 4 wherein a pair of said conical elements are disposed in said shell and are placed together to form a single uninterrupted expansion chamber, said conical elements have their larger ends in contact with their lateral parts in the form of flanges which are fitted between the flange ends of the body parts, the point of joining the two conical elements being at substantial center of the muffler body, said opening in each said conical element establishing communication between the single expansion chamber and the interior of the hollow body.

8. A device as defined in claim 7 wherein a baffle plate is secured to the small end of one of the cones and is shaped to allow the passage of an exhaust gas out of the exhaust port.

9. A device as defined in claim 5 wherein the area of the inlet port is substantially equal to the area of the outlet port.

10. A device as defined in claim 3 wherein said conical elements have substantially frusto-conical shape and are secured together with their small ends in contact, perforated tubes extend from the inlet and outlet ports into the chambers defined by the conical elements.

11. A device as defined in claim 10 wherein the perforations in said perforated tubes are located within the volume defined by each respective conical tube.

12. A device as defined in claim 3 wherein a baffle plate is secured to at least one of the conical elements and is apertured to allow passage for the exhaust gases.

13. A device as defined in claim 12 wherein said conical elements have a substantially frusto-conical shape and are secured together with their small ends in contact, said baffle plate being disposed around the periphery of the conical elements at the connected ends thereof and having a structural configuration effective to allow passage of the exhaust gases.

14. A device as defined in claim 12 wherein the conical elements have a substantially frusto-conical shape and are secured together with their small ends in contact, said shell includes a cup means fitted in the outlet port and having a closed imperforate end which faces the pair of conical elements.

15. A device as defined in claim 12 wherein said conical elements having substantially frusto-conical shapes disposed endwise with respect to each other within the shell to form at least one expansion chamber, said baffle plate extending transversely of said conical elements and substantially centrally of said shell, said baffle plate having a marginal edge portion extending laterally of the ends of the shell to which it is attached, said marginal edge portion having apertures disposed therein.

16. A device as defined in claim 12 wherein said conical elements have a substantially frusto-conical shape with large open ends secured together to form an expansion chamber therebetween, said baffle plate being secured to an end wall of the conical elements and extending transversely of said shell.

17. A device as defined in claim 16 wherein said baffle includes flanges disposed at right angles with respect to the planes of disposition of the baffle within the shell and contiguous to the inner surface of the shell.

18. A device as defined in claim 16 wherein the baffle plate is secured to the smaller end of one of the conical elements and includes edge portions spaced away from the inside of the shell to provide passages for the exhaust flow.

19. A device as defined in claim 18 wherein said baffle plate includes flanges disposed along the spaced apart edge portions of the baffle plate and contiguous to the inner surface of the shell.

* * * * *